US008900065B2

(12) United States Patent
Taylor

(10) Patent No.: US 8,900,065 B2
(45) Date of Patent: Dec. 2, 2014

(54) ELECTRONIC FIRING OF CASELESS PROPELLANT FOR A BALLISTIC IMPELLER GOLF CLUB

(76) Inventor: Roy Howard Taylor, Byhalia, MS (US)

( * ) Notice: Subject to any disclaimer, the term of this patent is extended or adjusted under 35 U.S.C. 154(b) by 213 days.

(21) Appl. No.: 13/385,999

(22) Filed: Mar. 21, 2012

(65) Prior Publication Data

US 2013/0252753 A1 Sep. 26, 2013

(51) Int. Cl.
*A63B 53/00* (2006.01)

(52) U.S. Cl.
USPC ..... 473/282; 473/131; 473/329

(58) Field of Classification Search
USPC ..... 473/282, 131, 329
See application file for complete search history.

(56) References Cited

U.S. PATENT DOCUMENTS 3,259,387 A * 7/1966 Beigay ..... 473/174
4,170,357 A * 10/1979 Greer ..... 473/333
5,522,594 A * 6/1996 Taylor et al. ..... 473/131
5,816,927 A * 10/1998 Taylor ..... 473/131
5,860,869 A * 1/1999 Duncalf ..... 473/131
5,924,932 A * 7/1999 Taylor ..... 473/131
6,139,440 A * 10/2000 Taylor ..... 473/131
6,872,148 B2 * 3/2005 Lee ..... 473/131
8,579,721 B1 * 11/2013 Taylor ..... 473/282

* cited by examiner

*Primary Examiner* — Stephen L. Blau

(57) ABSTRACT

A unique quiet reliable golf club capable of driving a golf ball varying distances utilizing a case-less propellant formulation, fired electronically without swinging the club. The golf club contains multiple loads of case-less propellant formulation in a shaft magazine capable of playing an entire game of golf without reloading. The striker piston and cylinder are disposed within the golf club head casting that contains a silencing chamber to lower the db output level. The striker piston is propelled outward by a high pressure case-less propellant gas injected into a vortex generator, located at the breech end of the cylinder. The vortex generator disperses the gas according to a desired distance setting of a ball travel distance scale. The one piece striker piston is sealed with a piston ring and is movable on a hard-coat cylinder-bearing surface that eliminates lubrication.

20 Claims, 5 Drawing Sheets

FIG. 4
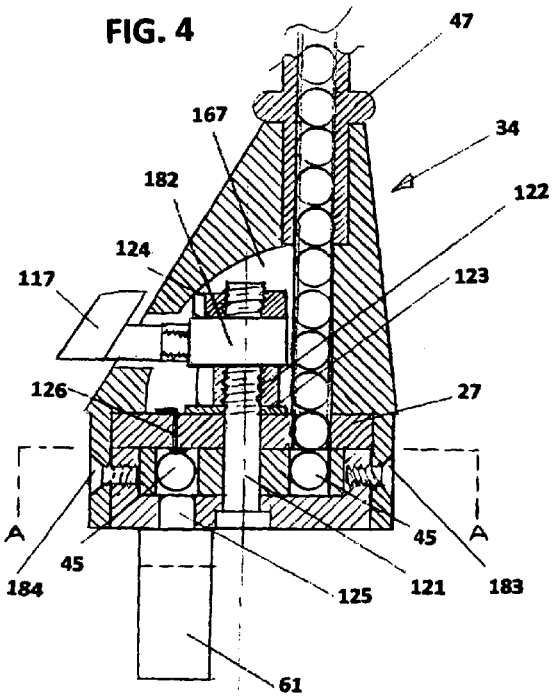
FIG. 5
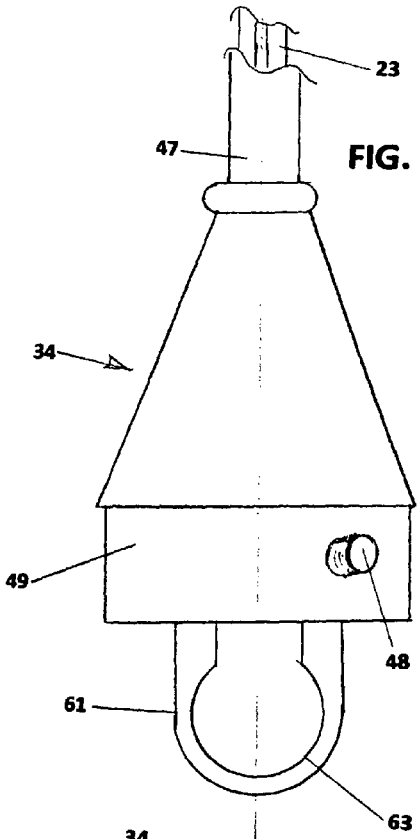
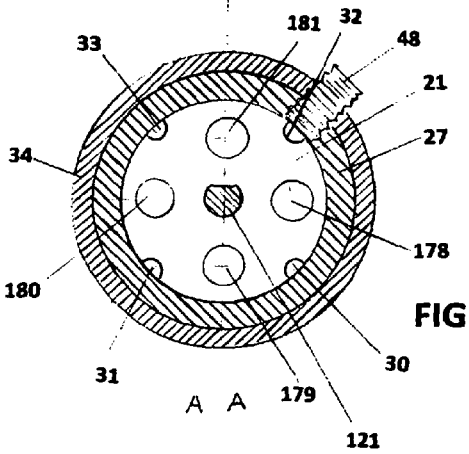
FIG. 2
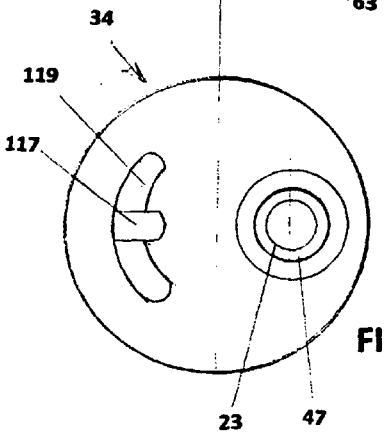
FIG. 3

ELECTRONIC FIRING OF CASELESS PROPELLANT FOR A BALLISTIC IMPELLER GOLF CLUB

BACKGROUND

1. Field of Invention

The present invention pertains to the field of golf clubs, specifically to a gas vortex generated by a case-less propellant electronically fired to drive a golf ball along the course of play, including a means of changing the distance a ball will travel.

2. Background Art

The recreational sport played on a golf course utilizes many types of golf clubs with varying face angles. Generally golf clubs are swung in an arc starting above the users head. This creates a club face velocity that imparts kinetic energy to the ball positioned on the ground or a tee. A shorter arc traveled by the club results in the transfer of less kinetic energy thereby varying the distance the ball travels. A key element of playing the game requires' controlling the precise direction and distance the ball travels along the course of play. Many users find playing the game of golf extremely challenging or unable to participate. To that end, many prior art attempts have been submitted to overcome this problem.

Clark disclosed in U.S. Pat. No. 769,939 issued Sep. 13, 2004 a means of adding additional energy imparted to the ball by the release of energy stored in a mechanical compressed spring. Driving the ball occurs by swinging the club head in a downward arc contacting the ball thereby triggering the energy release. The practical success of this concept was limited since most of the difficulty occurred by a swing error due to a heavier club and user proficiency. Additionally the ball compression energy release, the club head mechanical spring energy release and the club head velocity kinetic energy release will not result in the sum of the three sources and thereby, not providing any improvement.

Celestin discloses in French Pat. No. 1,181,539 issued Jun. 15, 1959 a golf club that uses an explosive charge to add additional energy to the club head velocity created by the user swinging the club. The club design apparatus being heavier is likely to cause an errant swing failing to trigger the device. Improved performance in driving the ball would be poor because the compressed energy in the ball would not occur at the precise instant the explosive charge occurred.

U.S. Pat. No. 4,170,357 issued Oct. 9, 1979 to Greer also employs an explosive charge designed to add kinetic energy to a golf ball when detonated by a swinging motion of a club face. This approach is not helpful for the same reason as that of a patent by Clark. Swinging a club with the added weight and hitting a sweet spot detonator to add explosive energy to a ball being compressed with kinetic energy is extremely difficult. The stored energy sources will not release simultaneously, thereby failing to solve the problem. The preceding patents require the user to swing a club, which is difficult even under conventional circumstances by a proficient user. Therefore the very problem the patents attempt to address and improve is defeated by the very means utilized.

The prior art issued Jun. 4, 1996 to Taylor et al discloses in U.S. Pat. No. 5,522,594 a golf club designed to impart kinetic energy upon a ball without swinging said club. Instead it is placed in a static position adjacent to said ball waiting for an impact by an external striker plate being affixed to one end of a narrow rod to be propelled by an explosive charge against a piston affixed to the opposite end of said rod. The Taylor et el invention includes a hollow head containing an oval shaped cylinder bore housing said piston, rod and external striker plate that seats into a recess in the retracted position. Said rod is guided in and out of said hollow head oval shaped cylinder bore through a bushing-bearing located on the clubface. The explosive charge contained in a rectangular shaped cartridge holder fitted into a slot that positioned the active cartridge above an orifice in the holler head oval shaped cylinder bore. A handle with a holler shaft that contains a trigging device with a spring and firing pin rod, extended into the holler head designed to fire said cartridge releasing high-pressure gas into a holler head oval cylinder port that directs the high pressure gas on to the top of said piston when the user actuates the trigger, thereby imparting kinetic energy upon the ball.

There were many problems with the Taylor et al invention that resulted in poor performance. The tremendous force caused the striker plate return spring to deform and said piston and striker plate to detach from said rod as a result of mechanical failure. The high pressure gas failed to burn completely leaving a residue that caused said piston to jam after a few cycles. The bushing-bearing containing petroleum lubrication changes into a sticky residue as a result of a chemical reaction when it is exposed to said high pressure gas, which restricted the smooth travel of said piston, small diameter rod and striker plate thereby causing failure. The hollow head being made of aluminum failed to withstand the wear factor caused by the said piston travel, resulted in failure. The cartridge holder being shaped with a flat surface failed to maintain an adequate seal thereby releasing high-pressure gas, thereby reducing the kinetic energy produced. Aside from the poor performance there were no means to adjust the ball travel distance.

Another prior art issued Oct. 6, 1998 to Taylor attempted in U.S. Pat. No. 5,816,927 again failed to achieve a clean complete powder burn resulting in parts jamming and said ball travel, failed as a result of most of the high-pressure gas being dissipated on the top of the piston before reaching the port designed to decrease the pressure, as a result said Taylor invention, failed to change the distance a ball would travel. This invention provided a hollow head fitted with a separate internal cylinder mounted within the aluminum embodiment containing the same design piston and rod attached to said external striker plate in the same manner as the Taylor et al patents, as a result sustained the same rate of failure. The Taylor patent did not address the piston rod bearing lubrication residue problem, which also continued to fail.

The high-pressure cartridges were contained in ducts around a wheel circumference and fired by a firing pin protruding through a hollow shaft into the head assembly striking each cartridge in a revolving sequence. The fired cartridges discharged into the center of the wheel, thereby passing through an injection port in the cylinder. The cone shaped center of the cartridge wheel fail to maintain an adequate seal, thereby allowing high-pressure gas to enter the adjacent cartridge ducts causing failure. The huge amount of volume between the top of the piston and the top of the cylinder created a premature drop in pressure thereby causing an incomplete powder burn which fouled the piston after a few cycles of operation.

The retractor means design attempt failed to retract the piston because the pressure volume required for the retracting action did not exist. The attempted buffer spring failed to be reliable. The assembled structure proved to be impractical, costly and difficult to manufacture. Also the head assembly and associated parts failed to withstand the dynamic operating pressure involved, namely the retraction concept, the tilt safety proved to be costly and impractical.

The U.S. Pat. No. 8,579,721 B1 by Taylor incorporates a clean burning vortex generator designed to reduce the unburned powder residue, which causes friction on moving parts resulting in reduced performance. The powder residue is inherit in gun powder as a result of its chemical structure, which may only be reduced not completely eliminated.

SUMMARY OF THE INVENTION

The present invention Ballistic Impeller Golf Club (golf club) features a golf club head with an attached handle assembly, designed to impart kinetic energy on to a golf ball without swinging the club. The kinetic energy is developed by burning a case-less propellant, that generates a high-pressure gas, which is adjustable in a linear fashion thereby, driving a golf ball along a course of play from a short distance, up to the distance of that of conventional clubs. The club head contains a cylinder and silencing chamber with an electronic firing port positioned at one end of the cylinder and directly over the vortex generator armature inlet ports housed in the breach end of said cylinder. The linear distance adjustment is accomplished by means of a vortex-generating armature that directionally disperses the high-pressure gas. The vortex-generating armature core contains a series of specially designed orifices that allow the high-pressure gas to flow in the exact proportion toward the piston end of the striker piston and or the silencing chamber thereby, controlling the amount of kinetic energy applied to the ball.

A portion of the invention is a unique electronic firing means for firing the case-less propellant formulation, not gun powder. Just as previous inventions used gun powder to drive a golf ball in the course of play, case-less propellant will be used and perform in the same manner. The high pressure gas generated by the case-less propellant leaves the injection port and flows in such a manner, where the shape of the vortex-generator chamber disperses the high pressure gas according to the distance adjuster setting. Another feature of this invention eliminates a piston, rod, bearing and strike plate assembly, which are prone to failure. They are replaced with a slotted especially hardened Teflon impregnated one piece, striker piston, which is moveable, riding on raised lands and grooves inside the diameter of the cylinder. The cylinder walls function as a bearing surface thereby, eliminating a conventional bearing and the need for lubrication. The slotted striker piston contains a urethane spring located in the piston end of the slot, which seats against a limit stop pin after the high-pressure gas discharge. This absorbs the energy and acts as a slotted striker piston brake at the end of the cycle. Other functions of the stop limit pin allows for quick removal, for cleaning and the stop pin also retains the cylinder to the club head casting. This invention uses an electronic firing means of a case-less propellant formulation, where a precise electrical current and voltage are applied to a ball shaped propellant formulation prepositioned in a firing port.

The club head assembly contains a shock reliever ring system to absorb the tremendous shock wave that develops after the high pressure discharge. The upper portion of the handle contains a battery, which provides the power to the electronic circuit board when the safety and firing switches contained in the lower portion of the handle are actuated. The casting contains a stainless steel cylinder and two "O" rings positioned at each end of the cylinder and are seated against the casting bore that seal the expansion chamber.

OBJECTS AND ADVANTAGES

Besides the objectives and advantages described above, to be more specific the objectives and advantages of the present invention are:

(a) To provide a unique low cost quiet golf club that is safe, operational, easy to use and easy to manufacture.

(b) To provide a unique golf club containing an electronic firing of a case-less propellant formulation through a vortex generator disbursement, imperative to controlling the linear distance a golf ball travels.

(c) To provide a unique golf club capable of hitting golf balls multiple distances without fouling or jamming.

(d) To provide a unique golf club containing a striker piston made of solid construction.

(e) To provide a unique golf club containing a striker piston not requiring a rod bearing and not requiring lubrication.

(f) To provide a unique golf club striker piston containing a urethane brake.

(g) To provide a unique golf club striker piston containing a special hard anodized Teflon impregnated coating.

(h) To provide a unique golf club casting made of aluminum, one piece construction.

(k) To provide a unique golf club containing a safe electronic firing case-less propellant formulation.

(l) To provide a unique golf club containing an easy to read, ball travel distance indicator.

(m) To provide a unique golf club containing, an in shaft propellant magazine.

(o) To provide a unique golf club containing an easy to assemble handle assembly.

(p) To provide a unique golf club containing a cylinder made of 17-4 stainless steel or other hard material.

(q) To provide a unique golf club containing a removable through stop pin that allows for easy disassembly.

(r) To provide a unique golf club containing a recoil shock wave reliever.

DRAWING FIGURES

FIG. 2 shows a cutaway view of the electronic firing chamber.

FIG. 3 shows a top view of the firing chamber casting.

FIG. 4 shows a cutaway view of the firing chamber casting.

FIG. 5 shows a perspective view of the firing chamber casting.

REFERENCE NUMERALS IN DRAWING

Figure 1:
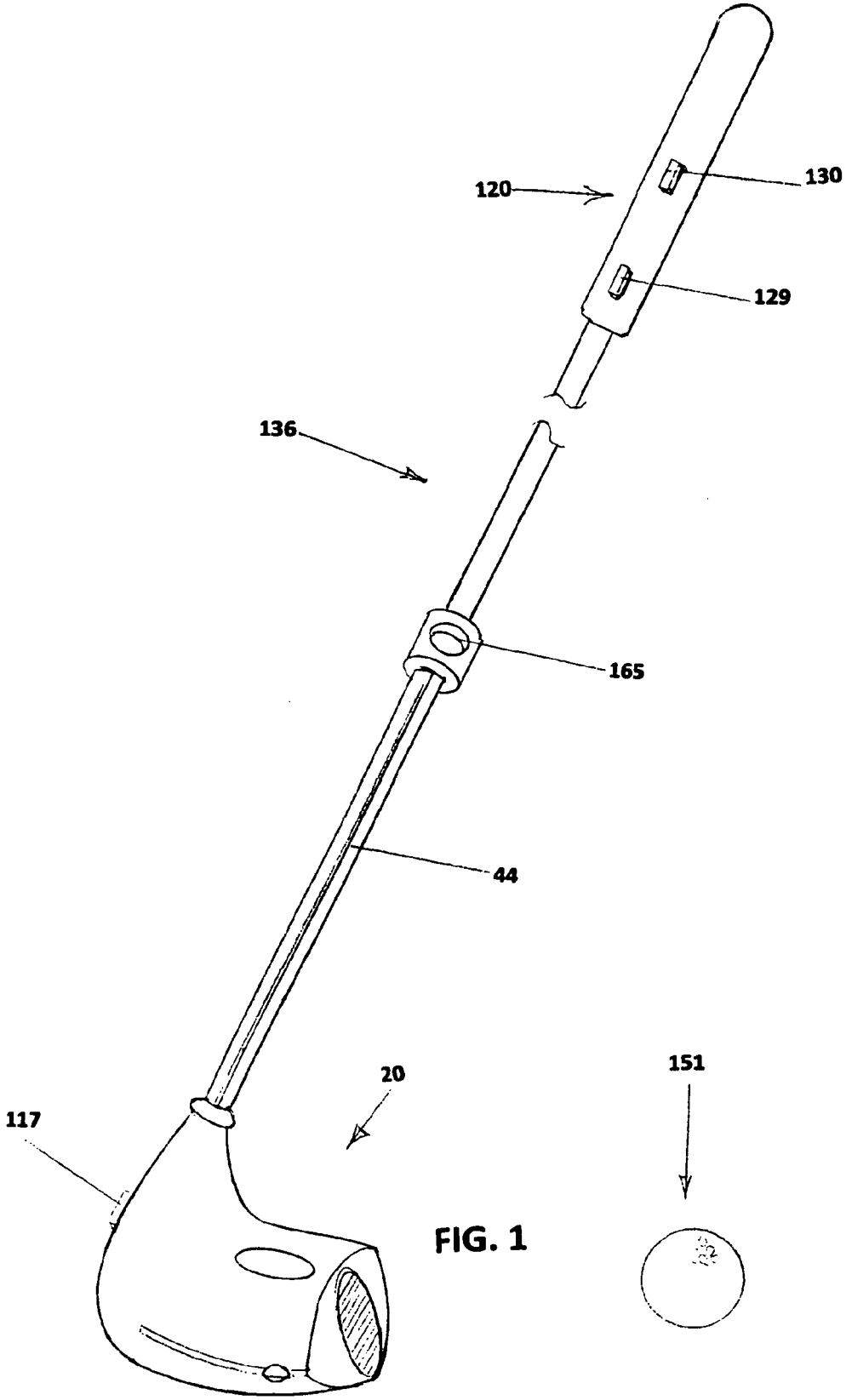
FIG. 1 shows a segmented perspective view of a golf club.
Figure 6:
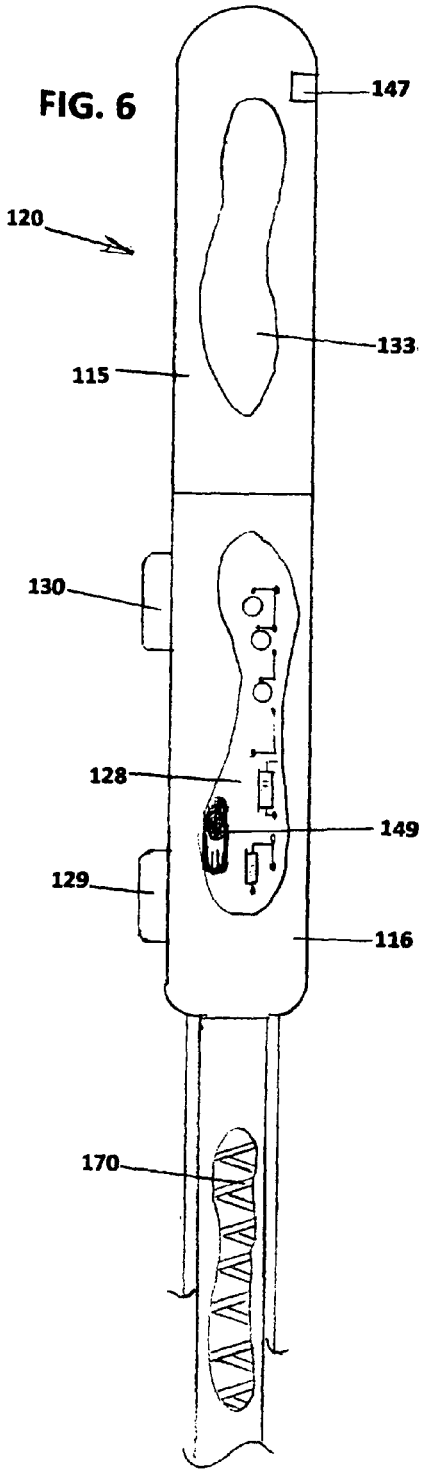
FIG. 6 shows a segmented perspective/cutaway view of the golf handle.
Figure 7:
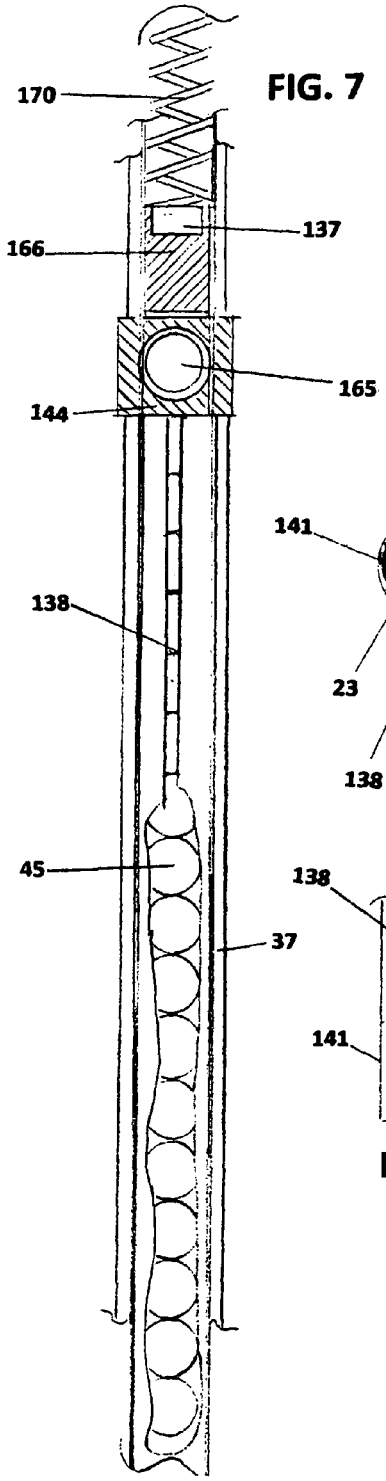
FIG. 7 shows a cutaway view of the golf club shaft magazine.
Figure 9:
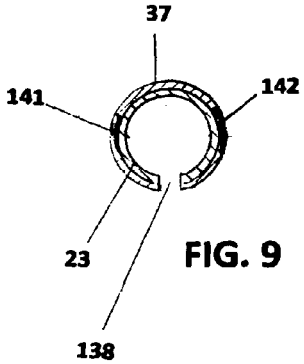
FIG. 9 shows a cutaway view of the golf club shaft magazine.
Figure 8:
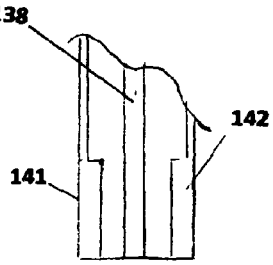
FIG. 8 shows a perspective view the golf shaft magazine connector.
Figure 12:
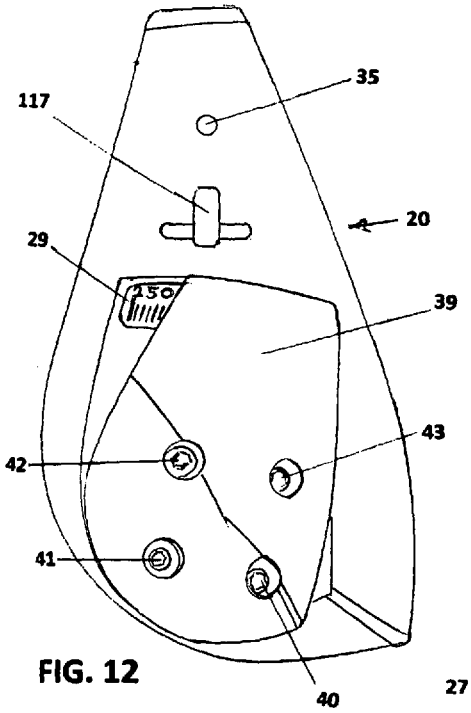
FIG. 12 shows the rear view of the golf club head range scale.
Figure 11:
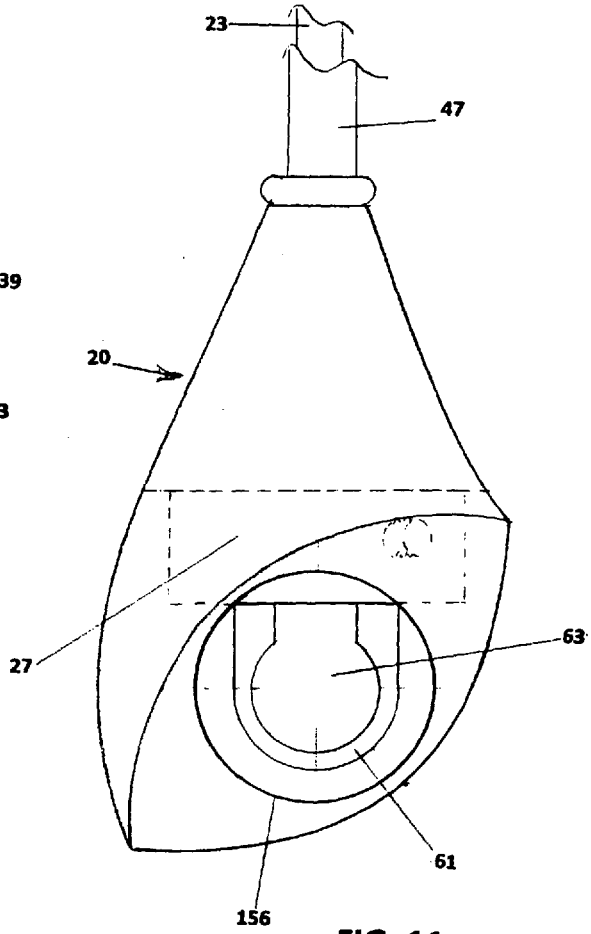
FIG. 11 shows a front view of club head with the cylinder removed.
Figure 10:
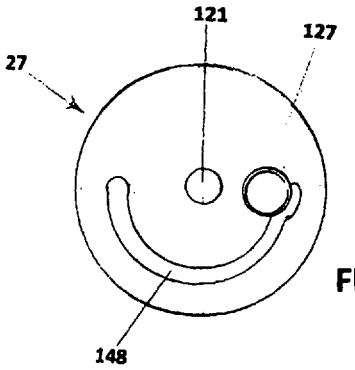
FIG. 10 shows a top view of the firing chamber.

20 golf club head casting
21 firing chamber rotor
22 left side golf club casting stop pin hole
23 golf club magazine shaft
24 stop pin retaining screw hole
25 cylinder

26 stop pin
27 firing chamber rotor housing
28 left side stop pin profile
29 ball travel distance scale
30 firing chamber rotor detent
31 firing chamber rotor detent
32 firing chamber rotor detent
33 firing chamber rotor detent
34 firing chamber casting
35 golf club handle shaft magazine coupling retainer screw hole
36 stop pin retaining screw
37 shaft magazine casing
39 distance adjuster indicator lever
40,41,42,43 distance adjuster lever mounting screw hole
44 lower shaft visual indicator slot
45 ball shaped case-less propellant
46 handle coupling mounting hole
47 shaft magazine coupling
48 firing chamber detent spring ball
49 firing chamber casting seat
50 distance adjuster shaft key
51,52,53,54 distance adjuster lever mounting screw
55 shock reliever ring
56 shock reliever wave spring
57 cylinder retainer ring
58 distance adjuster thrust washer
59 distance adjuster retaining nut
60 distance adjuster lock nut
61 aft cylinder mounting bracket
62 distance adjuster shaft mounting threads
63 aft cylinder enclosure
64 distance adjuster shaft "0" ring seat
68 golf club casting silencing chamber
69 distance adjuster vortex-generator shaft
71 vortex armature stem key slot
78 distance adjuster vortex-generator chamber housing
79 cylinder mounting thread hub
80, 82, 83, cylinder short distance vent port
88, 89, 90 vortex generator armature linear outlet vent port
93, 94, cylinder pre-exhaust port
99, 100 cylinder exhaust port
104 manual striker release access groove
105 left side cylinder stop pin hole
106 cylinder muzzle end
107 striker compression ring
108 piston end
109 striker piston bearing surface
110 striker piston
113 striker face groove
114 striker face of striker piston
115 upper handle grip cover
116 lower handle grip cover
117 firing chamber rotor ratchet lever
119 firing chamber rotor ratchet lever groove
120 golf club handle upper assembly
121 firing chamber rotor housing retaining bolt
122 firing chamber rotor housing retaining bolt nut
123 firing chamber rotor housing retaining bolt nut thrust washer
124 firing chamber rotor ratchet lock nut
125 firing chamber rotor housing firing port
126 case-less propellant firing contact
127 shaft electrical connector
128 propellant firing contact printed circuit
129 firing switch
130 safety switch
133 rechargeable battery
136 golf club shaft
137 spring follower latch
138 spring follower slot
141 positive electrical conductor
142 negative electrical conductor
144 propellant loading fixture
145 right side stop pin hole
147 battery recharge connector
148 firing chamber printed conductor
149 mercury safety tilt switch
151 golf ball
152 cylinder inlet port
153 stop pin right end profile
155 urethane spring
156 golf club casting bore
157 forward cylinder "O" ring
158 rear cylinder "O" ring
159 right side golf club casting stop pin hole
160,161,162,163 shock reliever mounting holes
164 distance adjuster indicator limit pin
165 propellant loading receptacle
166 magazine propellant follower
167 firing chamber casting enclosure
168 distance vortex armature
170 magazine propellant follower spring
172 golf club casting firing chamber receptacle
175 medallion recess
176 forward cylinder "O" ring groove
177 rear cylinder "O" ring groove
178,179,180,181 firing chamber ports
182 firing chamber ratchet
183 firing chamber mounting screw
184 firing chamber mounting screws

DETAILED DESCRIPTION OF FIGS. 1-14

Figures 13, 14:
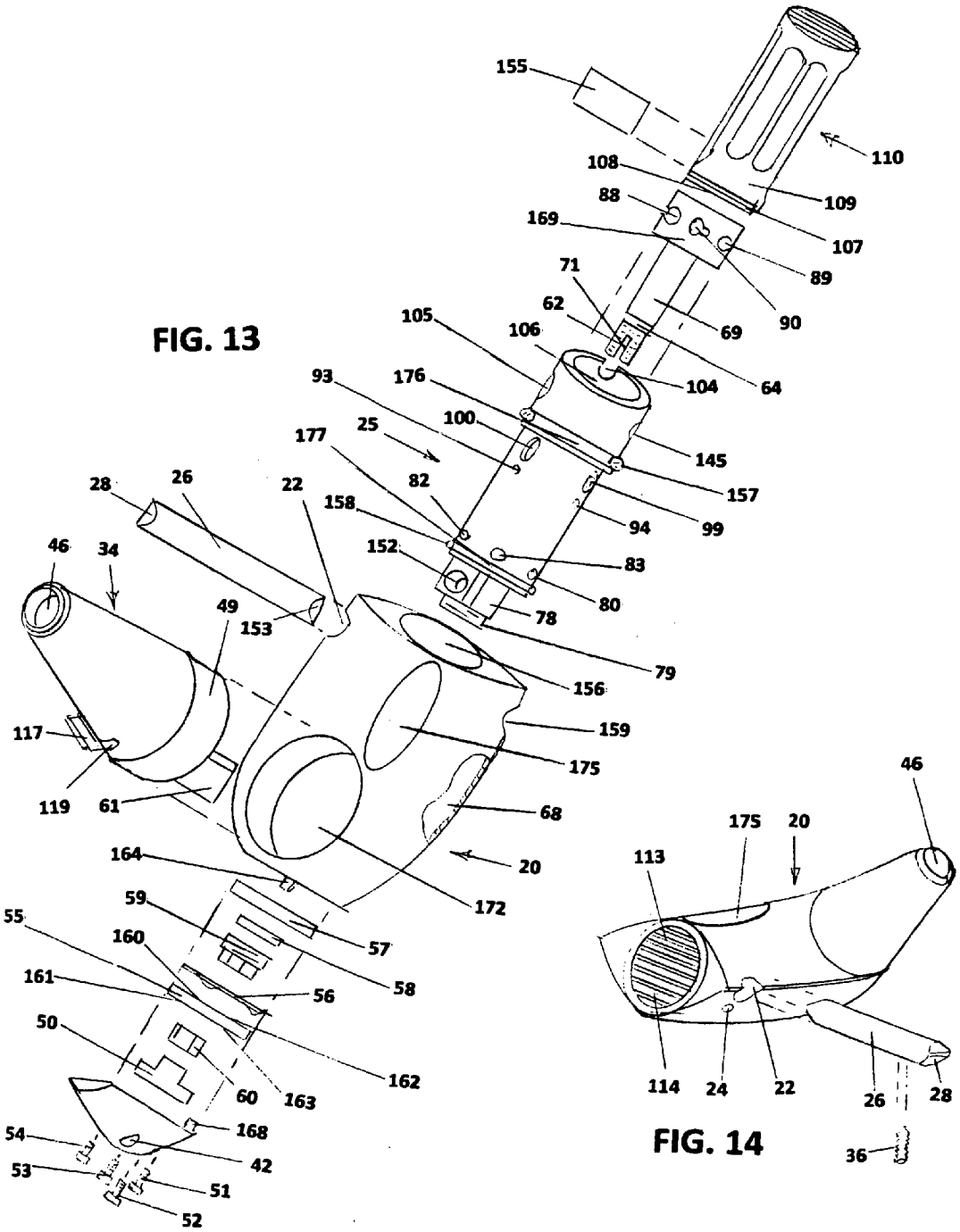
FIG. 13 shows an exploded view of the golf club head.
FIG. 14 shows an isometric exploded view of the golf club head.

A typical golf club illustrated in FIG. 1 is completely assembled ready for use. FIG. 1 through FIG. 14 clearly illustrate each component part interconnection. The golf club head casting 20 has a cylinder 25 and muzzle end 106 containing a striker piston 114 shown in the retracted position in FIG. 1 and FIG. 14 and striker piston 114 is shown in exploded view FIG. 13. The striker piston 110 has an elongated slot that provides a housing for a urethane spring 155. The stop pin 26 extends through golf club head casting 20 left side hole 22, through left side cylinder 25 stop pin hole 105, through striker piston 110 slot 112, through right side cylinder 25 stop pin hole 145 and through golf club head casting 20 right side hole 159 exposing stop pin 26 right end profile. The shaped heel of golf club casting 20 separates from golf club 20 and becomes a distance adjuster lever indicator 39 and rotates about an axis where rotation clockwise exposes the range distance scale.

Firing chamber casting 34 mounts in golf club head casting 20 with firing chamber casting seat 49 mating into golf club casting head casting 20 receptacle 172. Firing chamber casting 20 being fully seated provides a mounting means by positing aft cylinder bracket 61 in the center line with cylinder bore 156. Cylinder 25 slides into cylinder bore 156 where aft end of cylinder 78 engages into aft cylinder bracket 63 locking firing chamber 20 and cylinder together in place. Cylinder port 152 is positioned in alignment with firing chamber port 125 ready to receive the discharge of high pressure gas from firing chamber rotor 180, 181,178 and 179 as rotor 21 advances to detent position 30-33 with each firing. The golf club handle 136 contains a shaft magazine 23, loaded with ball shaped case-less propellant 45 formulation which is advanced by spring 170 into each firing port 178-181 after each firing. Propellant loading fixture 165 receives ball shaped case-less propellant 45 in the fully upward position filling magazine 23 and loading fixture 165 follows propellant depletion in a downward direction on shaft magazine casing 37 until all ball shaped case-less propellant 45 are consumed. The ball-shaped case-less propellant loading fixture 165 is manually retracted to the full upper position for reloading ball shaped case-less propellant 45.

Vortex generator armature 169 seats into the combustion-end of cylinder 25 encompassed by cylinder 25 exhaust ports 80, 82 and 83 with distance adjuster vortex generator shaft 69 extending through cylinder 25. Vortex linear vent ports 88-90 seat radically against inside cylinder 25 surface and work in concert with cylinder 25 ports 80, 82, 83. Distance Adjuster vortex generator shaft 64 is sealed by cylinder 25. Distance adjuster shaft key 50 fits into distance adjuster shaft 39 key slot 71 and into distance adjuster indicator lever 39. Thrust washer 58 provides a bearing surface for retaining nut 59 threaded on to vertex generator shaft 69 threads 62 and locked by lock nut 60 on threads 62. Shock reliever ring 55 is threaded on retaining nut 59. Shock reliever wave spring 56 applies tension between cylinder 25 retainer ring 57 and shock reliever ring 55. Cylinder 25 retainer ring 57 is threaded on to cylinder mounting thread hub 79. The distance adjuster indicator 39 is mounted to shock reliever ring 55 with distance adjuster mounting screws 51, 52, 53, and 54 are threaded into shock reliever mounting ring holes 160, 161, 162 and 163. Cylinder pre-exhaust ports 93, 94 and cylinder exhaust ports 99, 100 are closed off by striker piston bearing surface of lands and grooves 109 in the retracted position. Cylinder 25 forward and rear "O" rings 157 and 158 seats in cylinder 25 "O" ring grooves 176 and 177. The cylinder "O" rings 157 and 158 seat against golf club head casting 20 bore 156.

The golf club handle assembly 120 contains an upper handle grip cover 115 and lower handle grip cover 116. The lower section of golf club handle 120 contains a firing trigger switch 129 located in the forward end of lower handle grip 116 and the thumb safety switch 130 located in the rear of lower grip 116. The golf club handle assembly 120 is coupled to a golf club head 20 by shaft magazine head coupling 47 mated into handle coupling mounting hole 46 and retained by golf club handle retaining screw 35. The golf club shaft magazine 23 is mounted to a handle 120. The firing trigger switch 129 and safety switch 130 is mounted on printed circuit board 128 and circuit board 128 is mounted to handle 120. Printed circuit board 128 contains a safety orientation mercury switch 149.

Rechargeable battery is charged through electrical connector 147 and provides power to electronic circuit board 128 that develops the precise current and voltage transmitted through electrical contact 141 and 142 to firing contact 126. Ratchet handle 117 manually advances firing chamber rotor ratchet 182 by means of firing chamber containment bolt 121 to the next detent position seating spring ball 48 in detent notch 30-33 after firing. Spring 170 applies kinetic energy to spring follower 166, which forces propellant balls 45 through shaft magazine 23 into firing chamber rotor 21 ports 178-181 Propellant loading latch 137 holds loading fixture in a static position during the loading process.

Mounting screws 183-184 attach firing chamber 27 to firing chamber casting 34. Shaft magazine 23 spring follower slot 138 guides loading fixture 165 maintaining correct orientation and provides a visual indication of remaining propellant balls 45 remaining in shaft magazine 23.

Operation of FIGS. 1-14

In the present invention, those skilled in the art will understand the mechanical sequence described to launch a golf ball. With the golf club illustrated in FIG. 1 sitting in an upright position with shaft magazine 23 fully loaded ball shaped case-less propellant the user places said golf club head 20 adjacent to golf ball 151 and presses safety switch 130 with the left thumb and presses firing switch 129 contained in lower section of said golf club handle 120 with the right thumb.

To load the ball shaped case-less propellant 45 into golf club shaft magazine 23 the user places the golf club head casting 20 lower than handle 120 or in a vertical position with handle 120 in a rested position with access to propellant loading fixture 165 fully extended in the upward position with spring follow 137 in the locked position the user places the ball shaped case-less propellant 45 into propellant loading fixture 165 until shaft magazine 23 is completely full or the desired number of ball shaped case-less propellant 45 is loaded and is visible through lower shaft visual indicator slot 44.

The distance adjuster indicator lever 39 is positioned on a ball travel scale 29 to the desired range a ball is expected to travel. The golf club handle 120 is placed in an upright position with the golf club head casting 20 adjacent to golf ball 151. The user places both hands on golf club handle 120 in a conventional manner with the left thumb on thumb safety switch 130 and the right thumb on firing trigger switch 129.

When the user has aligned the golf club casting striker face 114 with golf ball 151 and directed toward the selected target, with golf club head casting 20 positioned in the firing position causes mercury switch 149 to make contact, then thumb safety switch 130 is activated and held in position, while the firing trigger switch 130 is being pressed. The activation of the orientation mercury switch 149 and both safety switch 130 and firing switch 129 will launch golf ball 151.

After the first cycle the user advances the firing chamber rotor 21 to the next firing position by moving ratchet lever 117 clockwise to the maximum position and counterclockwise to the opposite stop and clockwise until firing chamber rotor detent ball 48 seats into the next detent notch, 30-33. As each said ball shaped case-less propellant 45 moves into firing position firing contact 126 makes electrical contact with the ball shaped case-less propellant 45 ready to receive an electrical impulse from circuit board 128.

After firing occurs in firing chamber 34 high pressure case-less gas enters discharge port 125 continues through cylinder port 152 into vortex chamber 78 and is directed onto distance adjuster vortex armature 169. The flow forms a vortex where gas is divided by vortex armature shaft 69. This forces the case-less propellant gas to meet from opposite directions before entering vortex armature 169. The vortex gas flow pattern entering the vortex armature 169 further shapes the vortex flow pattern after leaving vortex generator armature 169 which is designed to maintain the optimum temperature throughout the linear degrees of pressure change required for given distance settings.

Depending upon the position of vertex generator armature 169 the gas flow is proportionally dispersed with an exact ratio, into cylinder 25 on to the top of said piston 108 and or into golf club casting silencing chamber 68. This action allows the case-less high-pressure propellant gas to expand thereby lowering the venting velocity of the high-pressure case-less propellant gas to an acceptable db level. The maximum distance setting on ball travel distance scale 29 allows the maximum gas flow into cylinder 25 applying full pressure to the piston end of striker piston 110. Pressure is retained on striker piston 110 by striker ring 107. The striker piston 110 slides on striker piston bearing surface of lands and grooves 109 consisting of a hard anodized Teflon impregnated coating, given distance before exposing cylinder pre-exhaust ports 93, 94 and exhaust ports 99,100 venting exhaust into a short distance silencing chamber 68. Depending on the position of golf club head casting 20, striker piston 110 is propelled outward causing striker face 114 to contact said golf ball 151 where golf ball 151 absorbing most of the kinetic energy generated by the case-less propellant gas pressure, which launches golf ball 151. The remaining kinetic energy is absorbed by urethane spring 155 becoming sandwiched between urethane housing in striker piston 110.

The user manually moves ratchet handle 117 clockwise to the limit position and counterclockwise position to limit stop and back to one of four detent notches 30-33 and manually presses said striker piston 110 to the retracted position thereby, readying the golf club 20 for the next cycle. As shown in FIG. 2-14 the machine and cast parts can be made by those skilled in the art, where these said parts fall in the category of parts commonly made in the industry.

CONCLUSION, RAMIFICATIONS AND SCOPE OF INVENTION

The invention teaches a means for driving a golf ball utilizing a ballistic impeller golf club by the use of case-less propellant formulation as opposed to the use of gunpowder thereby solving unburned powder residue and implementing a full bore bearing-less striker piston, a clean burning vortex generator, assembled into a stainless steel cylinder, which is contained in a one piece golf club casting.

The person reviewing this invention will clearly see and understand the importance for an invention to function and perform flawlessly in the market place. The scope of this invention far exceeds and improves all prior art by implementing a highly researched and developed case-less propellant formulation that burns in to a high pressure gas without any aftermath residue that is fired electronically with a precise electrical impulse signature, among other ramifications.

This invention reduces the cost of propellant charges and this invention provides higher reliability by implementing a 17-4 stainless steel or other stronger material cylinder combined with an especially hard-coated Teflon impregnated one-piece striker piston and urethane spring, to solve the lubrication problem as well as elimination of structural failure. This invention contains a silencing chamber to reduce the db sound level output. Other variations are possible, such as golf clubs that are multi-colored, manufactured for people that are left handed of smaller stature.

The invention claimed is:

1. A nonconventional, ballistic impeller golf club, comprising: a one piece golf club head casting, with a center line bore, with two "O" rings forming a silencing chamber within said head casting, that includes a cylinder, whereby said head casting and said cylinder, are locked together by means of a through stop pin, thereby forming a rigid attachment for said cylinder, where said golf club head casting also has an attached golf club handle, including a shaft magazine for storing and electronically firing a case-less propellant ball or other shaped, selected from a plurality of firing ports, contained in a firing chamber rotor connected to said cylinder inlet port, located at the breach end of said cylinder, where said cylinder comprises, a vortex generator, that directs the gas flow from said cylinder inlet port, into a plurality of vortex generator armature inlet ports, thereby providing a means to vary the distance a golf ball will travel, as well as effectively consuming high pressure gas from said case-less propellant, without any unburned residue being deposited on a constructed one piece bearing-less striker piston, restrained by a urethane spring, acting as a brake, riding in a longitudinal slot of said striker piston, providing a means to absorb the excess kinetic energy.

2. The golf club as recited in claim 1 further includes said one piece striker piston, which is retained in said cylinder and functions by providing a means for converting a case-less propellant energy into said kinetic energy, whereby said stop pin limits said striker piston, at the end of the a striker piston travel.

3. The golf club as recited in claim 1 further includes said one piece striker piston, which employs a full longitudinal bore diameter, mated inside said cylinder with a slide fit tolerance riding on a hard anodized Teflon impregnated coating, employing raised lands and grooves to provide for a cylinder wall bearing surface.

4. The golf club as recited in claim 2 contains said striker piston including a floating urethane spring riding in said longitudinal slot, with a tapered end recess, of said striker piston slot, providing a means for deceleration and a brake for said striker piston, whereby said urethane brake action occurs by a urethane spring being restrained between said stop pin and the inside of said striker piston slot and a urethane spring housing.

5. The golf club as recited in claim 1 further including a shaft magazine for storing case-less propellant balls or other shape formulation, where said shaft magazine provides a visual indication of the number of case-less propellant balls loaded into said shaft magazine and the shaft magazine also contains a spring actuated propellant loading follower.

6. The golf club as recited in claim 1 further including a one piece casting and a golf club shaft handle, thereby providing a housing means for said cylinder, case-less propellant, a battery and electronic circuit board.

7. The golf club as recited in claim 1 further including said firing chamber, which contain a plurality of said firing ports, provide for expanding said case-less propellant gas pressure to accelerate said striker piston.

8. The golf club as recited in claim 7 further including a handle frame that house an electronic circuit board, safety orientation mercury switch, safety switch and trigger switch.

9. The golf club as recited in claim 1 wherein said firing chamber is held in position by an aft end of said firing cylinder, which provide a mechanical sealing force between said firing chamber and said firing cylinder inlet port.

10. The golf club as recited in claim 1 further including a ball travel distance scale, which provide a means to indicate the distance a golf ball will be propelled, by rotating said vortex generator armature, by means of a distance adjuster indicator lever.

11. The golf club as recited in claim 1 comprises: said handle containing a shaft magazine, which house said case-less propellant balls, an electronic firing circuit and a battery, which is connected to a handle frame covered by a griping material made of rubber or other like material.

12. The golf club as recited in claim 1 further including said silencing chamber, formed between the "O" ring seals mating golf club casting bore, to each end of said cylinder thereby isolating the two side cavities of said golf club casting, thereby forming said silencing chambers.

13. The golf club as recited in claim 1 further including a plurality of firing chambers sized to create a predetermined high pressure, generated by case-less propellant formulation and fired by a precise predetermined signature level of electrical current and voltage.

14. The golf club as recited in claim 1 wherein includes a shock reliever ring and retaining means for a distance adjuster indicator lever.

15. The golf club as recited in claim 1 further including a vortex generator chamber sized for the use of case-less propellant, located in a port end of the firing cylinder, to provide a means to force high pressure case-less propellant gas into a vortex pattern to obtain maximum efficiency, where case-less propellant exhaust gas is directed to a top of said piston or a combination of said piston or into said silencing chambers, sealed by said "O" rings.

16. The golf club as recited in claim 1 further including a gas receiving multi-port armature to provide a linear dispersing of said gas through mating ports, where the armature rotates around a longitudinal axis connected to a shaft, that extends through said cylinder to a distance adjuster indicator lever, that exposes a graduated scale indicating the degree of rotation of said armature.

17. The golf club as recited in claim 1 further including a vortex generator with a shaft extending through a cylinder stem hole, where the said shaft provides a threaded mounting stud for anchoring said vortex generator against a thrust bearing, onto the cylinder inlet port end of cylinder, with a shaft end containing a key slot and extending into a distance adjuster indicator lever.

18. A nonconventional, ballistic impeller golf club, further including a shaft magazine for storing case-less propellant balls or other shape formulation, where said shaft magazine contains a spring actuated propellant loading follower, which feeds said case-less propellant ball into a firing chamber and case-less propellant gas into vortex generator disposed underneath inlet port of a cylinder, which has an armature containing a plurality of inlet ports and a plurality of discharge ports that work in concert with a plurality of cylinder silencing ports, which provide a means to direct case-less propellant gas pressure against a striker piston, or bypass said pressure into a golf club casting silencing chamber, thereby providing a means for a precise linear distribution ratio of high pressure case-less propellant gas.

19. The golf club as recited in claim 18 further including a single one piece solid constructed striker piston, providing a constant equal diameter beginning at a piston end and continuing to a striker face.

20. The golf club as recited in claim 19 further including a hard anodized Teflon impregnated coating to provide a bearing surface lubrication means for said striker piston.

* * * * *